US010779626B2

(12) United States Patent
Mehaddene et al.

(10) Patent No.: US 10,779,626 B2
(45) **Date of Patent: *Sep. 22, 2020**

(54) SKIN TREATMENT APPARATUS

(71) Applicant: Braun GmbH, Kronberg (DE)

(72) Inventors: Tarik Mehaddene, Karben (DE); Frieder Grieshaber, Neu-Anspach (DE); Bernhard Kraus, Braunfels (DE); Torsten Klemm, Eschborn (DE)

(73) Assignee: Braun GMBH, Kronberg (DE)

( * ) Notice: Subject to any disclaimer, the term of this patent is extended or adjusted under 35 U.S.C. 154(b) by 491 days.

This patent is subject to a terminal disclaimer.

(21) Appl. No.: 15/368,864

(22) Filed: Dec. 5, 2016

(65) Prior Publication Data

US 2017/0172277 A1 Jun. 22, 2017

(30) Foreign Application Priority Data

Dec. 22, 2015 (EP) ..... 15202029
Oct. 11, 2016 (EP) ..... 16193384

(51) Int. Cl.
*A45D 26/00* (2006.01)
*A61H 15/00* (2006.01)

(52) U.S. Cl.
CPC ..... *A45D 26/0023* (2013.01); *A45D 26/0028* (2013.01); *A45D 26/0038* (2013.01);
(Continued)

(58) Field of Classification Search
CPC ..... A45D 26/0038; A45D 26/0028; A45D 26/0023; A45D 26/0033; A45D 2026/008;
(Continued)

(56) References Cited

U.S. PATENT DOCUMENTS 5,367,599 A * 11/1994 Okada ..... B26B 19/28 388/809
6,306,148 B1 * 10/2001 Knesch ..... A45D 26/0028 606/133

(Continued)

FOREIGN PATENT DOCUMENTS

CN 108366660 A 8/2018
CN 108471858 A 8/2018

(Continued)

OTHER PUBLICATIONS

PCT International Search Report with Written Opinion in corresponding Int'l Appln. PCT/IB2016/057364 dated Feb. 20, 2017.

(Continued)

*Primary Examiner* — Tuan V Nguyen
*Assistant Examiner* — Chima U Igboko
(74) *Attorney, Agent, or Firm* — Kevin C. Johnson; StefanMichael Schneider

(57) ABSTRACT

A skin treatment apparatus, preferably an epilator, comprising at least one detector for detecting approximation and/or contact with the skin and a control unit to actuate the device depending on the signal received from the detector. The control unit has at least one regulator which increases the speed of the drive unit upon detection of an increased resistance and/or current consumption by a sensor and/or decreases the speed of the drive unit upon detection of an decreased resistance and/or current consumption by a sensor.

9 Claims, 4 Drawing Sheets

(52) U.S. Cl.
CPC ..... *A45D 2026/008* (2013.01); *A45D 2026/0085* (2013.01); *A61H 15/0078* (2013.01); *A61H 2015/0035* (2013.01); *A61H 2201/0153* (2013.01); *A61H 2201/0184* (2013.01); *A61H 2201/10* (2013.01); *A61H 2201/1207* (2013.01); *A61H 2201/1463* (2013.01); *A61H 2201/50* (2013.01); *A61H 2201/5058* (2013.01); *A61H 2201/5061* (2013.01); *A61H 2201/5064* (2013.01); *A61H 2201/5082* (2013.01); *A61H 2201/5092* (2013.01)

(58) Field of Classification Search
CPC ..... A61H 2201/5058; A61H 2201/50; A61H 2201/5064; A61H 2201/5061; A61H 2201/0184; A61H 2201/0153; A61H 2201/5082; A61H 2201/1463; A61H 15/0078; B26B 19/26; B26B 19/265; B26B 19/28; B26B 19/282; B26B 19/284; B26B 19/288; B26B 19/30; B26B 19/32; B26B 19/3886; B26B 25/002
USPC ..... 606/133
See application file for complete search history.

(56) References Cited

U.S. PATENT DOCUMENTS

| | | | | |
|---|---|---|---|---|
| 6,740,097 | B1 | 5/2004 | Sanchez-Martinez | |
| 9,888,757 | B2 | 2/2018 | Grieshaber et al. | |
| 1,016,041 | A1 | 4/2018 | Ohba et al. | |
| 10,016,041 | B2 | 7/2018 | Ohba et al. | |
| 10,111,509 | B2 | 10/2018 | Mehaddene et al. | |
| 2002/0065522 | A1* | 5/2002 | Yamaguchi ..... | A45D 26/0028 606/133 |
| 2005/0142093 | A1 | 6/2005 | Skover et al. | |
| 2005/0143755 | A1 | 6/2005 | Hashiguchi et al. | |
| 2006/0032053 | A1* | 2/2006 | Saker ..... | B26B 21/38 30/34.05 |
| 2008/0294176 | A1 | 11/2008 | Hashiguchi et al. | |
| 2011/0130770 | A1* | 6/2011 | Kraus ..... | A45D 26/0028 606/133 |
| 2011/0152884 | A1 | 6/2011 | Obkircher et al. | |
| 2016/0143410 | A1 | 5/2016 | Stampe et al. | |

FOREIGN PATENT DOCUMENTS

| | | | |
|---|---|---|---|
| EP | 1961329 | A1 | 8/2008 |
| EP | 1962633 | B1 | 9/2009 |
| EP | 2550935 | A1 | 1/2013 |
| EP | 3183992 | A1 | 6/2017 |
| EP | 3183993 | A1 | 6/2017 |
| ES | 2693148 | T3 | 12/2018 |
| ES | 2750732 | T3 | 3/2020 |
| FR | 2823080 | A1 | 10/2002 |
| JP | H05-56063 | U | 7/1993 |
| JP | 2001128728 | | 5/2001 |
| JP | 2008289818 | A | 12/2008 |
| JP | 2012130486 | A | 7/2012 |
| JP | 2018538098 | A | 12/2018 |
| JP | 2019503758 | A | 2/2019 |
| JP | 6698846 | B2 | 5/2020 |
| WO | WO2004/035138 | | 4/2004 |
| WO | 2005092142 | A1 | 10/2005 |
| WO | 2010066966 | A1 | 6/2010 |
| WO | 2014024084 | A1 | 2/2014 |
| WO | 2014206852 | A1 | 12/2014 |
| WO | 2017109617 | A1 | 6/2017 |
| WO | 2017109650 | A1 | 6/2017 |

OTHER PUBLICATIONS

Mohamed Gamil Gabr; Notice of Allowance; U.S. Appl. No. 15/379,550; dated Jul. 13, 2018; United States Patent and Trademark Office; Alexandria, Virginia.

Witkowska-Piela, A.; Extended European Search Report; European Patent Application No. 16202096.0; dated Feb. 28, 2017; European Patent Office; Munich, Germany.

Witkowska-Piela, A.; Communication pursuant to Article 94(3); European Patent Application No. 16193384.1; dated Mar. 20, 2018; European Patent Office; Munich, Germany.

Written Opinion; Japanese Patent Application No. 2018-532631; dated Oct. 1, 2019; Japanese Patent Office; Tokyo, Japan.

Awakura, Yuji; Notice of Reasons for Refusal; Japanese Patent Application No. 2018-532631; dated Jun. 25, 2019; Japanese Patent Office; Tokyo, Japan.

Witkowska-Piela, A.; Extended European Search Report; European Patent Application No. 16193384.1; dated May 16, 2017; European Patent Office; Munich, Germany.

Written Opinion; Japanese Patent Application No. 2018-532634; dated Nov. 27, 2019; Japanese Patent Office; Tokyo, Japan.

Yamamoto, Takeharu; Notice of Reasons for Refusal; Japanese Patent Application No. 2018-532634; dated Aug. 20, 2019; Japanese Patent Office; Tokyo, Japan.

Yamamoto, Takeharu; Notice of Reasons for Refusal; Japanese Patent Application No. 2018-532634; dated Mar. 10, 2020; Japanese Patent Office; Tokyo, Japan.

Witkowska-Piela, A.; International Search Report and Written Opinion; International Patent Application No. PCT/IB2016/057656; dated Mar. 6, 2017; European Patent Office; Rijswijk, Netherlands.

* cited by examiner

SKIN TREATMENT APPARATUS

FIELD OF THE INVENTION

The present invention is concerned with a skin treatment apparatus, especially with an epilator for removing body hair with a plucking cylinder having preferably pincer-like clamping elements for plucking hair. The skin treatment apparatus comprises at least one application device, e.g. the plucking cylinder of an epilator, for contacting the skin of a user, a drive unit for driving the at least one application device and a control unit for controlling movement of the at least one application device, e.g. by controlling actuation of the drive unit.

BACKGROUND OF THE INVENTION

Such a skin treatment apparatus in the form of an epilator for plucking hairs from human skin is known e.g. from WO 2005/092142 A1. This apparatus comprises an electric motor as a drive unit which is coupled via a gear ring to a plucking cylinder which forms an application device. The control unit may have the form of a switch for turning the drive unit on and off.

Root hair removal using epilators is usually accompanied by an excessive noise arising from the different moveable mechanical components of the apparatus, in particular the plucking cylinder with its pincer-like clamping elements for plucking hair. This noise can increase stress and effects the well-being sensation of the user. In some cases it even initiates a fear sensation leading to undesired psychological and physiological effects which may interfere causing an increase in pain sensitivity.

In EP 1 962 633 B1 it is suggested to provide a stimulation apparatus for stimulation the skin prior or after the treatment by a plucking cylinder of an epilator. The stimulation apparatus comprises rollers provided on either side of the plucking cylinder which rollers are provided with several protrusions. Although such a stimulation apparatus decreases the pain sensitivity, the noise generated by an apparatus for skin treatment, like an epilator, still causes undesired psychological and physiological effects.

JP 2001 128728 A discloses a hair removal device with a detection means constituted by a spring wherein the detection means is pivotable with respect to a body casing. Further, the detecting means may detect an overload by means of a control circuit that blocks an electric circuit by interrupting a switch which is arranged to stop the drive motor of the device. An overload voltage may be indicated by means of a display or a buzzer.

Further, WO 2014/024084 A1 discloses a skin treatment apparatus with a control unit operably connected to a pressure or contact sensor for detecting a pressure with which a skin contacting element is pressed against the skin, and configured to control a motor to rotatably drive a rotor head in dependence of a pressure signal generated by the pressure sensor. In one example the frequency of rotation or oscillation of the rotor head is made dependent on the contact pressure such that the frequency of rotation or oscillation is increased as the contact pressure increases, while rotation or oscillation of the rotor head ceases in case no skin contact is detected.

In WO 2010/066966 A1 a handheld body care appliance is disclosed comprising a means for detecting the proximity of the skin to the treatment head and an electronic control unit suitable for at least authorizing the operation of the treatment means if skin is detected near the treatment head.

The proximity sensing means include at least a light source facing a proximity sensing zone located near the treatment head and at least a light sensor from the proximity sensing zone.

Reducing the noise produced by the epilator by limiting its technical origin requires the development of a new plucking system which represents a huge technical challenge which may contravene the goal of keeping production costs low. In addition, amending the technique of plucking hairs may have a detrimental factor on the quality of hair removing.

It is an object of the present disclosure to provide an improved skin treatment apparatus avoiding drawbacks of known devices.

SUMMARY OF THE INVENTION

In accordance with one aspect of the present disclosure the skin treatment apparatus further comprises at least one detector for detecting approximation of the at least one application device to the skin of a user or detecting contact for the at least one application device with the skin of a user. The detector is coupled to the control unit for transmitting a signal to the control unit. Further, the control unit is designed and arranged such that it controls activation of the drive unit and/or the at least one application device depending on the signal received from the detector. In other words, actuation of the at least one application device depends on whether or not the skin treatment apparatus is in contact with the skin of a user or at least close to contacting the skin of a user. In this respect, the term activation is not limited to switching the drive unit and/or the at least one application device on and/or off, but may further include for example switching between different operation modes and/or tuning the speed of the drive unit and/or the at least one application device. According to one aspect, the control unit may comprise at least one regulator for tuning the speed of the drive unit. For example, the apparatus may be turned on by a main switch which causes the drive unit to be actuated at a low speed, thus producing less noise. If the apparatus approaches and/or contacts the skin of a user the speed is significantly increased, e.g. to the speed required for efficient hair removal. After removal of the apparatus from the user's skin, the apparatus is again turned into a low speed modus with reduced noise generation. In an alternative exemplary embodiment the apparatus may be turned into the low speed modus upon approaching the user's skin and may be switched into the high speed modus upon contacting the user's skin. Further, the apparatus is provided with a detector comprising a sensor which is suitable for measuring the resistance to actuation of the at least one application device, e.g. by measuring the torque required for actuation of the at least one application device, and/or for measuring the current consumption of the drive unit, e.g. the motor. Preferably, the control unit is designed and arranged such that the at least one regulator increases the speed of the drive unit upon detection of an increased resistance and/or current consumption by the sensor and that the at least one regulator decreases the speed of the drive unit upon detection of an decreased resistance and/or current consumption by the sensor.

In more detail, the control unit may comprise a rotational speed governor and may be provided with a control algorithm regulating the rotational speed of the drive unit to a predefined value, which may preferably be set as required, irrespective of influences on operating voltage or load. The control unit is preferably configured to increase and decrease the rotational speed of the drive unit depending on the load, e.g. torque. For example, the drive unit is initially tuned to a low speed, which may be too low for proper operation of the apparatus, resulting in low current consumption and reduced noise. If the control unit detects a change in the load, the algorithm tunes the drive unit to a higher speed suitable for proper operation. As soon as the load drops below a threshold value, the algorithm tunes the drive unit back to the lower speed. The algorithm may use values like current consumption or battery voltage.

Further, the control unit may generate a warning feedback if a maximum load threshold is reached. Switching between low speed and high speed may include slow acceleration and/or slow deceleration. In addition or as an alternative, the speed may be adjusted in different steps.

When the skin treatment apparatus, e.g. the epilator, is applied onto the skin, the apparatus is activated and turns from an off-state or an idle-state into an on-state setting the plucking cylinder or the like application device into motion. On the other hand, the skin treatment may turn off as soon as it is lifted up from the skin or shortly thereafter. This contributes to strongly reducing the total perceived noise during use of the apparatus, and, thus, to decrease the stress level of the user, allowing for a more pleasant treatment experience. Increasing the well-being of the user by decreasing the stress contributes to reducing the pain sensation. In addition, the current consumption can be significantly reduced by minimizing the run time of the at least one application device. This feature is especially important for use under water, e.g. in a bath tub, where the resistance against the movement of the at least one application device, for example the rotational movement of the plucking cylinder, and hence the current consumption is significantly higher compared the dry usage of the apparatus.

According to a preferred aspect of the disclosure, the control unit comprises at least one switch for turning the drive unit on and off. The drive unit and, thus, the at least application device coupled to the drive unit, is in its off-state or idle-state as long as the application device is neither in contact nor close to the skin of a user. On the other hand, approaching or contacting the skin of user switches the apparatus into an on-state thereby turning on the drive unit which in turn activates the application device.

There are various different types of detectors which are suitable for use in the skin treatment apparatus including mechanical detectors, electric or electronic detectors and a combination thereof. For example, a mechanical detector may include a pin or a lever which is moved upon approaching of the skin treatment apparatus or its application device to the skin of a user. In other words, the signal transmitted from the detector to the control unit may be a movement of the mechanical detector and/or a transmission element coupled to the mechanical detector.

According to an aspect the at least one application device is the mechanical detector or part of a detector, for example a mechanical detector. In this respect, the at least one application device may be displaceably and or pivotably mounted in the apparatus with a displacement and/or pivoting of the at least one application device being transmitted to the control unit. A plunger or the like transmission element may be used to connect the at least one application device, preferably via the rotational axis of a plucking cylinder of an epilator, to a switch or the like control unit. The rotational axis of the plucking cylinder may be spring loaded and is preferably able to move with a minor displacement, preferably less than 1 mm. This minor displacement can be used to actuate the switch. A spring force can be chosen so that a slight pressure is required for actuation. Preferably, the rotational axis of the plucking cylinder is spring loaded and displaceable along guides at two opposite ends or along one guide only. As an alternative, the plucking cylinder may be mounted in the skin treatment apparatus, preferably in a spring loaded manner, such that a relatively large displacement, i.e. more than 1 mm, is required for actuating the switch or the like control unit. This implementation conveys a softer impression of the epilator to the user and may help decreasing friction at high contact pressure.

According to a further embodiment, the skin treatment apparatus further comprises at least one stimulation element which is displaceably and/or pivotably mounted in the apparatus. Displacement and/or pivoting of the stimulation element may be transmitted to the control unit either directly or indirectly via at least one transmission element. In other words, a stimulation element may be used as a mechanical detector or as a part thereof. In contrast to the use of the at least one application device as a mechanical detector, the use of a stimulation element as a mechanical detector has the benefit of not increasing the friction between the at least one application device and the user's skin when pressing the at least one application device onto the skin. This is especially useful in an epilator or other devices, for example massage devices, having movable component parts which contact the user's skin during operation of the device.

If the at least one application device and/or the at least one stimulation element is used as the mechanical detector or as a part thereof, it is preferred to bias the at least one application device and/or the at least one stimulation element by at least one elastically deformable element. The application device and/or the stimulation element is preferably displaceable against the bias of the at least elastically deformable element, preferably a compression spring, by a force applied by contacting the skin of a user with the application device and/or the stimulation element.

In a still further aspect of the present disclosure the skin treatment apparatus comprises a body with the at least one application device being pivotably mounted in and/or on the body. Pivoting of the at least one application device preferably occurs about a swiveling axis which may be located parallel to the rotational axis of a plucking cylinder in an epilator. The application device may be held in an idle state by at least one spring or the like elastically deformable element. During use of the skin treatment apparatus the application device may be pivoted about the swiveling axis against the bias of the spring or the like. This swiveling movement of the application device may be transmitted to the control unit, i.e. to a switch or the like, to trigger actuation of the application device and/or to alter the speed of the application device. In more detail, the at least one application device may be coupled to a plunger (See FIG. 6 and FIG. 7, element '15') acting on the control unit, which plunger 15 is connected to a yoke spring. This yoke spring is set into movement by pivoting the application device about the swiveling axis. Preferably, the plunger 15 is spring loaded to intercept the displacement resulting from the swiveling movement or the yoke spring movement.

The use of a swiveling motion of the at least one application device may be used for an additional effect which is especially useful if the apparatus is an epilator with a rotating plucking cylinder. Many users tend to tilt the skin treatment apparatus forwards in use, thereby hindering a complete contact of the application device with the skin. For example, tilting an epilator forward prevents complete contact of the plucking cylinder with the skin. The feature of the swiveling motion being used to activate the apparatus thus can be used to further ensure a correct handling of the apparatus. In other words, the apparatus is only operated if the handling of the apparatus is correct which is assessed by the swiveling motion only occurring in the correct position and orientation of the apparatus with respect to the skin.

According to a still further embodiment, the at least one application device is coupled to the drive unit via a slipping clutch. A displacement and/or a pivoting of the at least one application device may be used to coupled and decouple the application device and the drive unit. In other words, instead of using an on-off-switch to control the status of the apparatus, a slipping clutch can be used to control the actuation of the at least one application device, e.g. to control the rotation of the plucking cylinder, while the motor of the drive unit continuously runs whether the apparatus is in contact with the skin or not. In this respect it has been noted that the noise generated by the motor has no or merely a limited detrimental effect on the well-being of a user as long as the plucking cylinder or the like application device is not driven. The application device is preferably spring loaded such that the application device is uncoupled from the drive unit if the apparatus is not in contact with the skin, whereas if the apparatus is set onto the skin, the drive unit is coupled to the application device and drives the application device. In this embodiment the slipping clutch may be seen as a control unit controlling movement of the at least one application device by coupling and decoupling the application device and the drive unit.

In a different embodiment of the present disclosure, the detector may comprise at least one of a pressure sensor, a proximity sensor, a heat sensor and a contact sensor. In more detail, the distance between the user's skin and the skin treatment apparatus can be measured by an optical or an ultrasonic sensor to control the status of the apparatus. For example an epilator is switched off if it is held away from the skin and is turned on if it comes close to or in contact with the skin. Such a sensor may either by used to directly detect the distance between the user's skin and the application device of the apparatus or may be used to detect a movement of the at least one application device and/or a stimulation element. The latter option may further be used to ensure a correct handling of the apparatus during usage. For example, a swiveling movement of the application device may be required to actuate the application device. Further, the apparatus may feature an electrical circuit to control the drive unit. The circuit may operate by detecting skin contact by change of external resistance of detecting skin proximity by detecting a change in capacity.

A skin treatment apparatus according to the present disclosure is preferably provided with at least the control unit and/or the drive unit sealed in a water-tight manner in a body of the apparatus. Especially, if a mechanical detector is used, a switch or the like control unit may be covered a membrane. This allows use of the apparatus e.g. in a shower or a bath tub.

According to a preferred embodiment, the skin treatment apparatus is an epilator with the application device being a plucking cylinder for removing hair from the skin of a user. The plucking cylinder is driven by the drive unit, e.g. an electric motor, to rotate about an axis. As an alternative, the apparatus may be an electric shaver or a massage device for skin treatment.

In addition to the control unit the skin treatment apparatus may further comprise one switch for activating and deactivating the apparatus. For example this additional switch may be used to fully turn off the apparatus irrespective of skin contact. The additional switch may further by used to turn the apparatus into a mode which allows actuation of the at least one application device controlled by the control unit. Still further, the switch may be used to turn the apparatus into a mode in which the application device is permanently activated irrespective of skin contact. In other words, a user may choose and switch between three different modes: permanently off, permanently on (irrespective whether on the skin or not) and an auto-mode actuating the application device only upon approaching or contacting the skin.

When using the apparatus in short strokes, such an auto-modus may be inconvenient to the user due to switching on and switching off at frequent intervals. According to a preferred embodiment, a time delay is provided in a way that the apparatus keeps on running a short time after lifting it up from the skin. After the delay time is over, the apparatus turns off. In other words, the control unit may comprise a timer that is arranged such that the application device is driven by the drive unit for defined time span after detecting removal of the application device from the skin of a user.

According to a further embodiment, the apparatus is provided with a feedback device indicating the state or mode of the apparatus to a user. This is especially helpful if the control unit turns off the drive unit until the application device approaches or contacts the user's skin. This may be misunderstood by a user as a malfunction of the apparatus. However, if a feedback signal, e.g. an optical feedback and/or an acoustical feedback is generated, this may be used to indicate to the user that the apparatus is e.g. in its auto-mode.

In a preferred embodiment of the present disclosure, a method for operating a skin treatment apparatus is provided. The method comprises the steps of providing a skin treatment apparatus having at least one application device for contacting the skin of a user and a drive unit for driving the at least one application device; detecting approximation and/or contact of the at least one application device with a user's skin; and actuating the at least one application device depending from the result from the previous step. In other words, detection of approximation and/or contact of the at least one application device and the skin is used to turn the apparatus on and off or even for tuning the speed of the drive unit and/or the at least on application device. After removal of the at least one application device from the skin, the apparatus may be switched off or its speed may be reduced described above in more detail.

Further details and features of the invention may be obtained from the following description of embodiments in conjunction with the drawings.

DETAILED DESCRIPTION OF THE INVENTION

Figure 9:
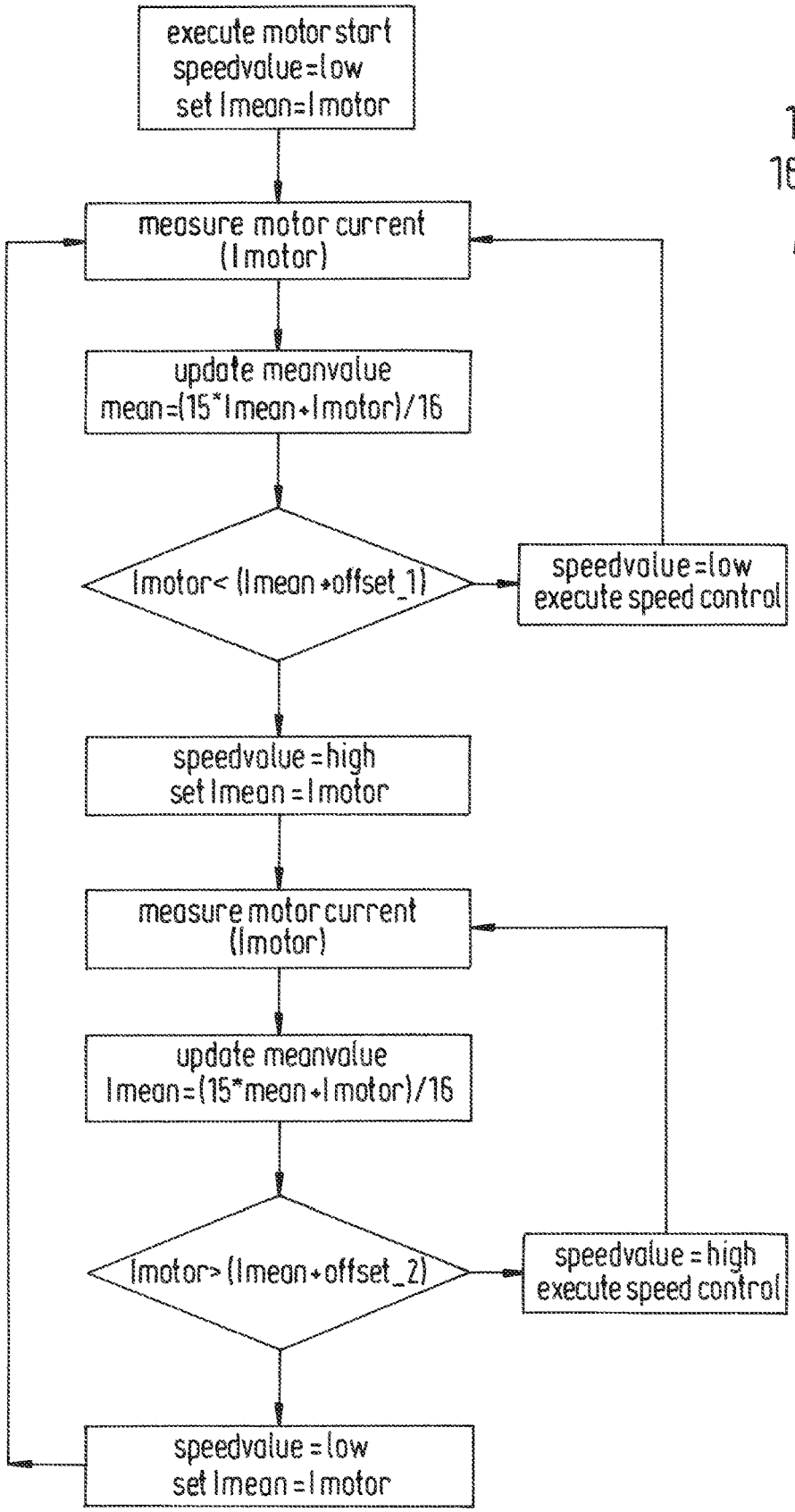
FIG. 9 shows a flow chart of the algorithm of the epilator of FIG. 8.

The epilators depicted in FIGS. 1 to 7 and as described in the following may comprise a sensor measuring the resistance to actuation of a plucking cylinder or the like application device and/or the current consumption of a drive unit as described e.g. with reference to FIGS. 8 and 9. A control unit may be designed and arranged such that a regulator increases the speed of the drive unit upon detection of an increased resistance and/or current consumption by the sensor and that the regulator decreases the speed of the drive unit upon detection of a decreased resistance and/or current consumption by the sensor.

Figure 1A:
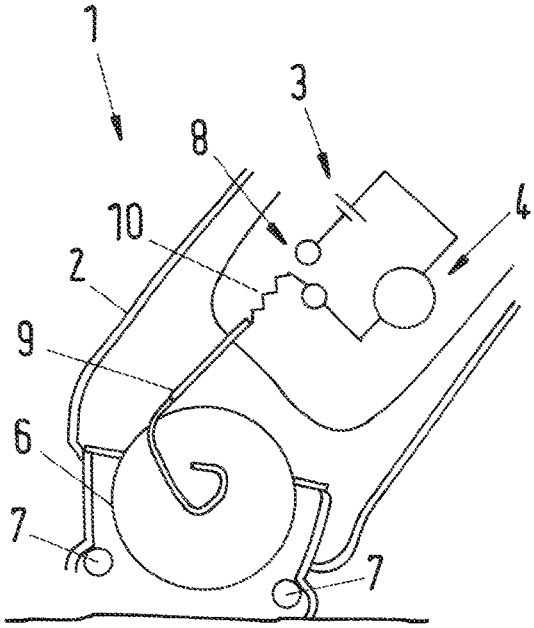
FIG. 1*a* shows in a schematic sectional view an epilator according to a first embodiment of the invention in a switched off state.
Figure 1B:
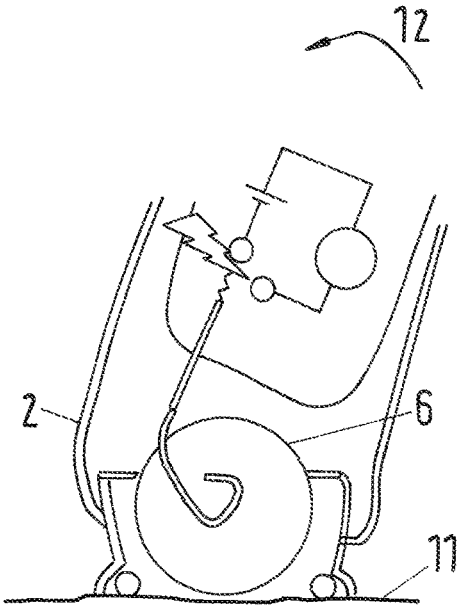
FIG. 1*b* shows the epilator of FIG. 1*a* in a switched on state.

In the embodiment of FIGS. 1*a* and 1*b* a skin treatment apparatus in the form of an epilator 1 is shown comprising a body 2 or housing. A drive unit is provided within the body 2 comprising an, e.g. rechargeable, battery 3 and an electric motor 4. The electric motor 4 is coupled by a gearing 5 (cf. FIG. 2) to a plucking cylinder 6, i.e. an epilator drum with e.g. pincer-like clamping element for plucking and removing hair from a user's skin. The epilator 1 further comprises two stimulation elements 7 in the form of rollers provided on either side of the plucking cylinder 6. The stimulation elements 7 are held in an idle state as depicted in FIG. 1*a* with respect to the body 2 of the housing. The stimulation elements 7 may perform a swiveling movement with respect to the body 2 as can be taken from a comparison of FIG. 1*a* and FIG. 1*b*.

Switch 8 is provided interposed between the battery 3 and the electric motor 4 such that actuation of the switch 8 turns the electric motor 4 on and off. The switch 8 is connected to a yoke spring 9 and a further spring 10 which are arranged such that the switch 8 is open, i.e. turning the electric motor 4 off, when the epilator 1 is in its idle state as shown in FIG. 1*a*.

As the epilator 1 is approaching the user's skin indicated by line 11 in FIGS. 1*a* and 1*b* the stimulation elements 7 contact the skin 11 the epilator 1 may be tilted slightly as indicated by arrow 12 in FIG. 1*b* to bring both stimulation elements 7 as well as the plucking cylinder 6 located there between in contact with the skin 11. This tilting movement results in closing switch 8 by the movement of yoke spring 9 and spring 10. In other words, the epilator 1 is switched on to set plucking cylinder 6 in rotating motion by contacting the user's skin 11 and tilting the body 2 of the epilator 1 as shown in FIG. 1*b*. In other words, the stimulation elements 7 together with the yoke spring and the further spring 10 act as a detector for detecting approximation and/or contact of the plucking cylinder 6.

Figure 2:
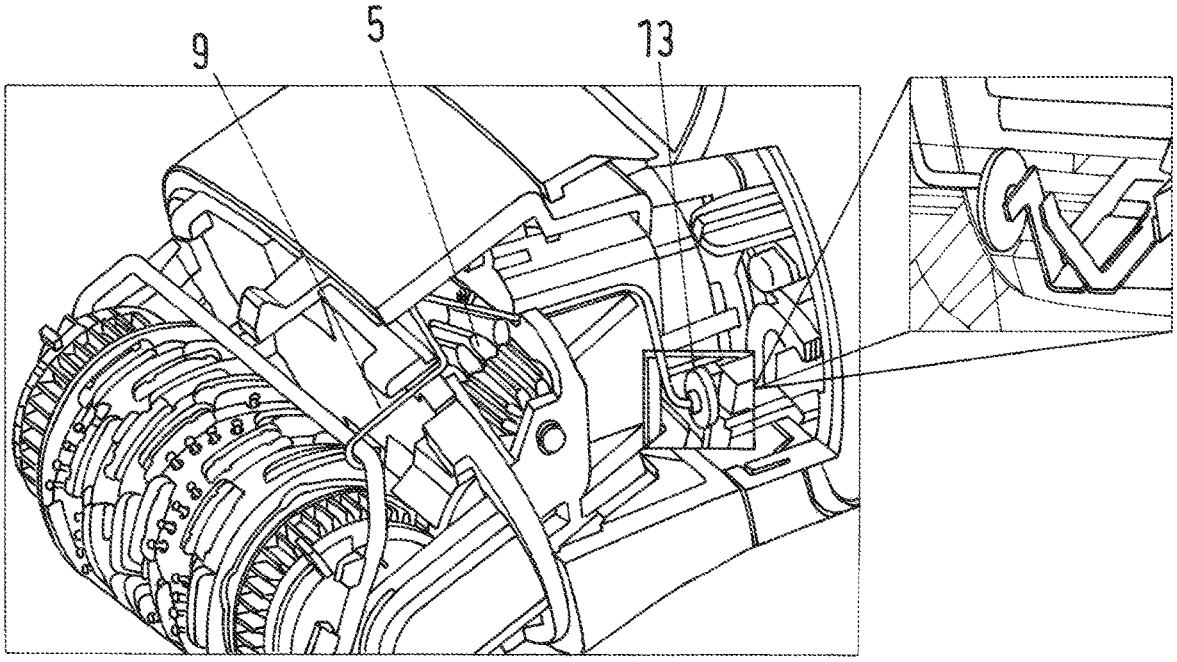
FIG. 2 shows a cut away view on an epilator according to a second embodiment of the invention.

FIG. 2 shows a more detailed embodiment of the epilator 1 depicted in FIGS. 1*a* and 1*b* with a slightly amended design of the yoke spring 9 which includes the further spring 10. Stimulation elements 7 are omitted in the embodiment of FIG. 2 but may be provided if desired. In addition, FIG. 2 shows that switch 8 may be covered by a membrane 13 such that within body 2 the drive unit (battery 3 and electric motor 4) and the switch 8 forming a control unit are sealed in a water-proof manner.

Figure 3A:
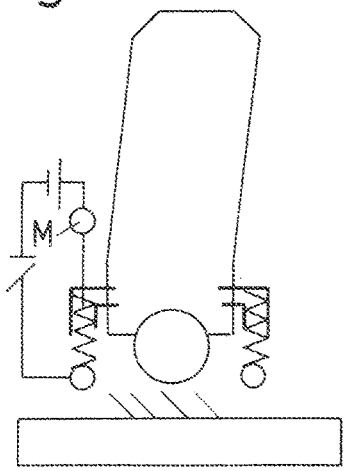
FIG. 3*a*, 3*b* show a schematic sectional view of an epilator according to a third embodiment of the invention in a switched off state and a switched on state, respectively.
Figure 3B:
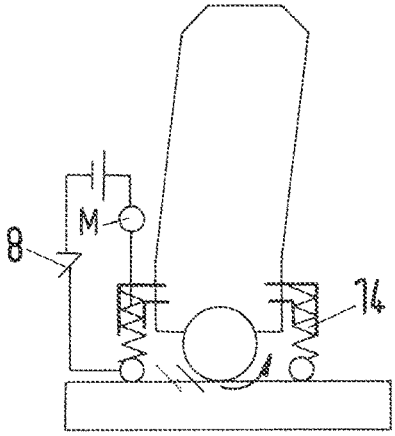

An alternative embodiment of an epilator 1 is depicted in FIGS. 3*a* and 3*b*. In a similar manner as in the embodiment of FIGS. 1*a* and 1*b* the switch 8 (control unit) is actuated by the stimulation elements 7 acting as a detector. However, in the embodiments of FIGS. 3*a* and 3*b* it is mainly an axial displacement in the vertical direction as seen in FIGS. 3*a* and 3*b* which turns the epilator 1 on and off. In this respect, the stimulation elements 7 are mounted in the body 2 of the epilator 1 in a displaceable manner biased by springs 14. This results in the epilator 1 being switched off as long as the stimulation elements 7 are not in contact with the skin 11 as shown in FIG. 3*a*. However, if the epilator 1 is pressed against the user's skin 11 as shown in FIG. 3*b* such that the stimulation elements 7 are axially displaced against the bias of springs 14 until the plucking cylinder 6 contacts the skin, the switch 8 is closed, thereby turning the epilator 1 on.

Figure 4A:
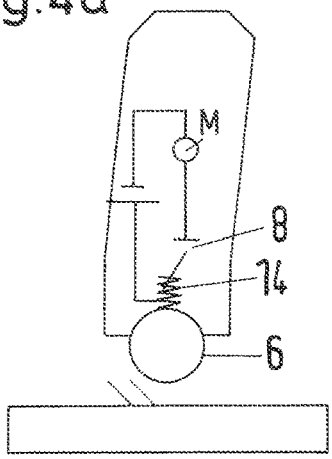
FIG. 4*a*, 4*b* show schematic sectional views of an epilator according to a fourth embodiment of the invention in a switched off state and switched on state, respectively.
Figure 4B:
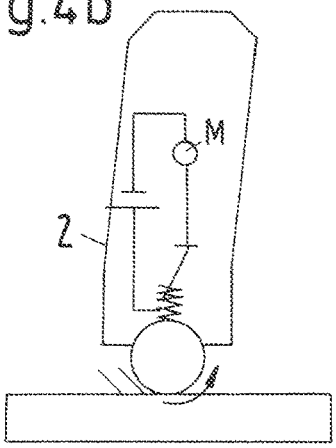

The embodiment depicted in FIGS. 4*a* and 4*b* shows a similar alternative wherein the plucking cylinder 6 is the detector which together with a transmission arm opens or closes switch 8, thereby turning the epilator 1 on and off depending on the pressure applied to a user's skin by plucking cylinder 6. More detailed embodiments of this idea area shown in FIGS. 6 and 7, wherein only a small axial displacement of the plucking cylinder 6 of less than 1 mm is allowed in the embodiment of FIG. 6, while a larger axial displacement of more than 1 mm is allowed in the embodiment of FIG. 7.

Figure 5A:
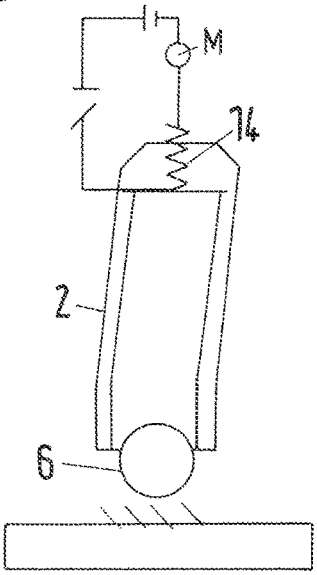
FIG. 5*a*, 5*b* show in a schematic sectional view an epilator according to a fifth embodiment of the invention in a switched off state and a switched on state, respectively.
Figure 5B:
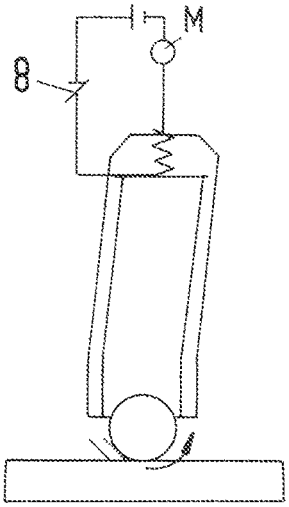
Figure 6:
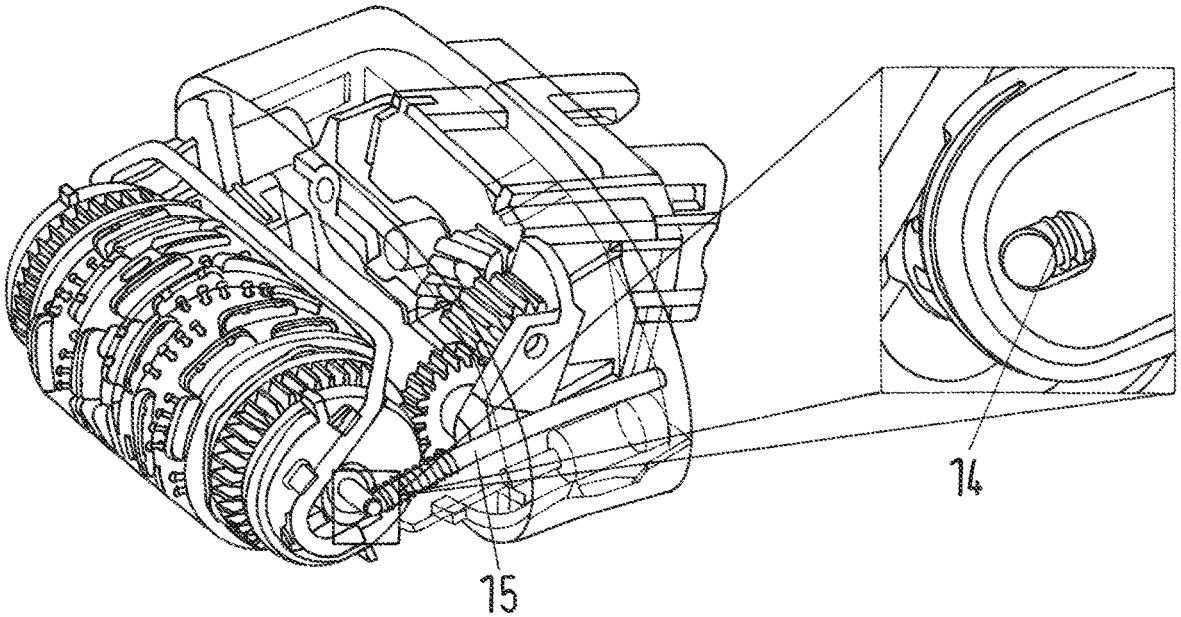
FIG. 6 shows in a cutaway view on an epilator according to a sixth embodiment of the invention.
Figure 7:
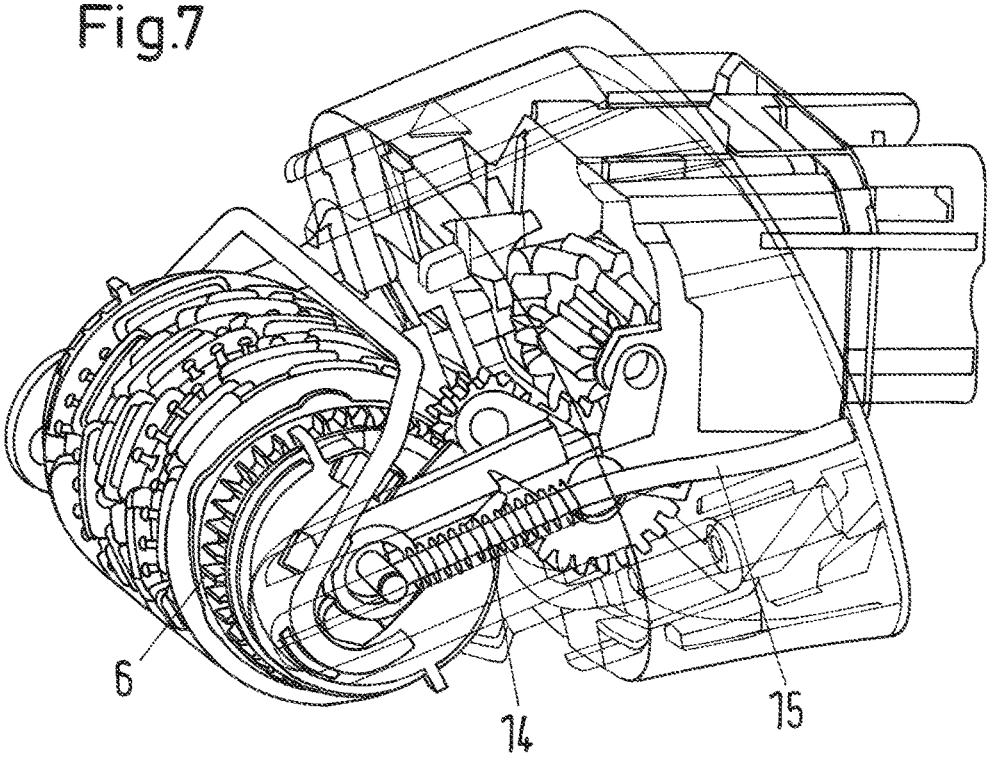
FIG. 7 shows a cutaway view on an epilator according to a seventh embodiment of the invention.

A still further alternative is depicted in the embodiment of FIGS. 5*a* and 5*b*. In this embodiment the plucking cylinder 6 and component parts of the drive mechanism form a unit which is axially displaceable with respect to the body 2 of the epilator 1. Although the switch 8, the battery 3 and the electric motor 4 are indicated as being outside the body 2 in the schematic views of FIGS. 5*a* and 5*b*, these component parts may be provided within the body 2 of the epilator, preferably within the unit comprising the plucking cylinder which is axially moveable with respect to the body 2. Again, the switch 8 is closed by pressing the plucking cylinder onto the user's skin 11 to thereby activate the epilator 1.

Figure 8:
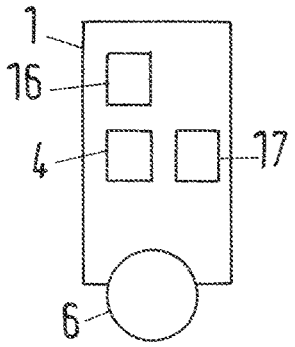
FIG. 8 shows in a schematic sectional view an epilator according to an eighth embodiment of the invention.

FIG. 8 shows a schematic view of an epilator 1 with a motor 4 for driving a plucking cylinder 6. A sensor 16 (detector) is provided cooperating with a regulator 17 of the control unit, e.g. a speed governor, for measuring the load, e.g. by measuring the rotational speed of the plucking cylinder, the torque or the current consumption, for driving the plucking cylinder 6 and for setting a rotational speed of the drive unit by the regulator 17. For example, the regulator 17 of the control unit may be provided with a control algorithm regulating the rotational speed of the drive unit to a predefined value, while the control unit is configured to increase and decrease the rotational speed of the drive unit depending on the load. FIG. 9 shows an example of a flow chart of such an algorithm, wherein the drive unit is initially tuned to a low speed. If the sensor 16 of the control unit detects a change in the current consumption, the algorithm tunes the drive unit to a higher speed. As soon as the current consumption drops below a threshold value, the algorithm tunes the drive unit back to the lower speed.

In more detail, the sensor 16 determines the current consumption Imotor of the motor 4 every 10 ms. A mean value Imean is calculated using the last 16 values. The current consumption Imotor is compared with the mean value Imean and a predefined threshold offset_1. This threshold may be used to adjust sensitivity of changes in current consumption. If the change in current consumption exceeds the mean value Imean by the threshold offset_1, regulator 17 tunes the rotational speed of the motor 4 to a higher speed and adapts the mean value Imean. Reducing speed is effected in a similar manner using a second threshold offset_2. This algorithm has the benefit of not requiring an absolute threshold, thereby increasing sensitivity.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An epilator apparatus comprising at least one plucking cylinder for contacting the skin of a user, a drive unit for driving the at least one plucking cylinder, the at least one plucking cylinder being displaceably or pivotably mounted in the apparatus, at least one skin contacting stimulation element, the at least one stimulation element being displaceably or pivotably mounted in the apparatus, wherein the at least one plucking cylinder or the at least one stimulation element is biased by at least one spring and the at least one plucking cylinder or the at least one stimulation element is movable against the bias of the at least one spring by a force applied by contacting the skin of a user with the at least one plucking cylinder or the at least one stimulation element, a control unit for controlling movement of the at least one plucking cylinder, wherein the at least one plucking cylinder or the at least one stimulation element is coupled to the control unit, such that the control unit controls actuation of the drive unit driving the at least one plucking cylinder in response to the at least one plucking cylinder or the at least one stimulation element contacting the skin of the user and moving against the bias of the spring.

2. The apparatus in accordance with claim 1, wherein the control unit comprises at least one switch for turning the drive unit on and off.

3. The apparatus in accordance with claim 1, wherein the at least one plucking cylinder is coupled to a plunger acting on the control unit which plunger is connected to a yoke-spring, wherein the yoke-spring is set into movement by pivoting of the at least one plucking cylinder about a swiveling axis.

4. The apparatus in accordance with claim 1, wherein the at least one plucking cylinder is driven by the drive unit to rotate about an axis.

5. The apparatus in accordance with claim 1, wherein the control unit comprises a timer and wherein the control unit is designed and arranged such that the at least one plucking cylinder is driven by the drive unit for a defined time span after detecting removal of the at least one plucking cylinder from the skin of a user.

6. The apparatus in accordance with claim 1, wherein the at least one skin contacting stimulation element comprises at least one stimulation roller.

7. The apparatus in accordance with claim 1, wherein the at least one skin contacting stimulation element comprises a curved surface for contacting the skin of a user.

8. An epilator apparatus comprising at least one plucking cylinder for contacting the skin of a user, a drive unit for driving the at least one plucking cylinder, a control unit for controlling movement of the at least one plucking cylinder, and a sensor measuring the resistance to actuation of the at least one plucking cylinder or the current consumption of the drive unit, wherein the control unit comprises at least one regulator for tuning the speed of the drive unit, wherein the control unit is designed and arranged such that the at least one regulator increases the speed of the drive unit upon detection of an increased resistance or current consumption by the sensor and that the at least one regulator decreases the speed of the drive unit upon detection of a decreased resistance or current consumption by the sensor, wherein the sensor is designed and arranged to determine the current consumption of a motor of the drive unit in a given time interval, and wherein the control unit is designed and arranged to calculate a mean value using a given number of previous values of the current consumption, to compare the current consumption with the mean value and a given threshold and to tune the rotational speed of the motor and to adapt the mean value depending on the result of the comparison.

9. An epilator comprising at least one plucking cylinder for contacting the skin of a user, a drive unit for driving the at least one plucking cylinder and a control unit for controlling movement of the at least one plucking cylinder, the at least one plucking cylinder being displaceably or pivotably mounted in the apparatus, wherein the at least one plucking cylinder is biased by at least one spring and the at least one plucking cylinder is movable against the bias of the at least one spring by a force applied by contacting the skin of a user with the at least one plucking cylinder, wherein the at least one plucking cylinder is coupled to the control unit, such that the control unit controls actuation of the drive unit driving the at least one plucking cylinder in response to the at least one plucking cylinder contacting the skin of the user and moving against the bias of the spring.

* * * * *